US011319784B2

(12) United States Patent
Maenza et al.

(10) Patent No.: US 11,319,784 B2
(45) Date of Patent: May 3, 2022

(54) CONTROL LINE GUIDANCE SYSTEM FOR DOWNHOLE APPLICATIONS

(71) Applicants: Frank J. Maenza, Houston, TX (US); Matthew J. Krueger, Cypress, TX (US)

(72) Inventors: Frank J. Maenza, Houston, TX (US); Matthew J. Krueger, Cypress, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/019,831

(22) Filed: Sep. 14, 2020

(65) Prior Publication Data

US 2022/0081998 A1 Mar. 17, 2022

(51) Int. Cl.
*E21B 43/10* (2006.01)
*E21B 33/12* (2006.01)

(52) U.S. Cl.
CPC ..... *E21B 43/105* (2013.01); *E21B 33/1208* (2013.01); *E21B 43/106* (2013.01)

(58) Field of Classification Search
CPC .... E21B 43/103; E21B 43/105; E21B 43/106; E21B 33/1208; E21B 17/1035
See application file for complete search history.

(56) References Cited

U.S. PATENT DOCUMENTS

| | | | | |
|---|---|---|---|---|
| 6,173,788 | B1 | 1/2001 | Lembcke et al. | |
| 7,836,960 | B2 | 11/2010 | Patel et al. | |
| 8,083,001 | B2 | 12/2011 | Conner et al. | |
| 8,869,903 | B2 | 10/2014 | Thomas et al. | |
| 9,303,478 | B2 | 4/2016 | Scruggs et al. | |
| 10,329,866 | B2 | 6/2019 | Frazee et al. | |
| 10,364,641 | B2 | 7/2019 | Carmody et al. | |
| 2006/0243450 | A1* | 11/2006 | Head | E21B 17/028 166/369 |
| 2009/0250228 | A1 | 10/2009 | Loretz et al. | |
| 2009/0283254 | A1 | 11/2009 | Andersen et al. | |
| 2016/0290062 | A1 | 10/2016 | Richards | |

OTHER PUBLICATIONS

International Search Report and Written Opinion for International Application No. PCT/US2021/050054; International Filing Date Sep. 13, 2021; dated Dec. 3, 2021 (pp. 1-8).

* cited by examiner

*Primary Examiner* — Kristyn A Hall
(74) *Attorney, Agent, or Firm* — Cantor Colburn LLP

(57) ABSTRACT

A downhole tool including a tubular member having an outer surface and an inner surface defining a flow bore. An expandable member is arranged on the outer surface. The expandable member is selectively radially outwardly expandable. An activation mechanism is operatively connected to the expandable member. The activation mechanism is operable to radially outwardly expand the expandable member. A control line extends along the outer surface and over the expandable member. A control line guidance system is operable to shift the control line radially outwardly from the outer surface.

20 Claims, 8 Drawing Sheets

CONTROL LINE GUIDANCE SYSTEM FOR DOWNHOLE APPLICATIONS

BACKGROUND

In the resource exploration and recovery industry, control lines are often run from a surface system, along a tubular string, to one or more downhole systems. In some cases, the control line is passed downhole through an inner diameter (ID) of the tubular string. The control line may run through a conduit arranged radially inwardly of the ID, or in a void defined between an outer diameter and the ID. In other cases, the control line is run outward of the OD. In such cases, the control line is routed in such a way so as to not interfere with downhole tool operation.

Certain downhole tools are designed to expand radially outwardly into sealing contact with a casing tubular or inner surface of an open hole. The control line may be run into an opening above such a tool, and out through another opening below the tool. In other cases, the control line may be passed through a groove, channel or slot in the tool. Regardless of the routing, the control line cannot be run in a way that would interfere with tool operation. Running a control line internally of the OD may detract from an overall flow area of the tubular string. Running a control line externally of the OD requires special considerations, structure and the like to prevent interference with tool operation.

SUMMARY

Disclosed is a downhole tool including a tubular member having an outer surface and an inner surface defining a flow bore. An expandable member is arranged on the outer surface. The expandable member is selectively radially outwardly expandable. An activation mechanism is operatively connected to the expandable member. The activation mechanism is operable to radially outwardly expand the expandable member. A control line extends along the outer surface and over the expandable member. A control line guidance system is operable to shift the control line radially outwardly from the outer surface.

Also disclosed is a resource exploration and recovery system including a surface system and a subsurface system including a tubular string extending from the surface system into a wellbore. The tubular string includes a downhole tool including a tubular member having an outer surface and an inner surface defining a flow bore. An expandable member is arranged on the outer surface. The expandable member is selectively radially outwardly expandable. An activation mechanism is operatively connected to the expandable member. The activation mechanism is operable to radially outwardly expand the expandable member. A control line extends along the outer surface and over the expandable member. A control line guidance system is operable to shift the control line radially outwardly from the outer surface.

Still further disclosed is a method of shifting a control line radially outwardly of a tubular, the method including initiating an activation mechanism to radially outwardly expand an expandable member arranged on an outer surface of a tubular, actuating a control line guidance system with the activation mechanism, and radially outwardly shifting the control line relative to the outer surface with the control line guidance system.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
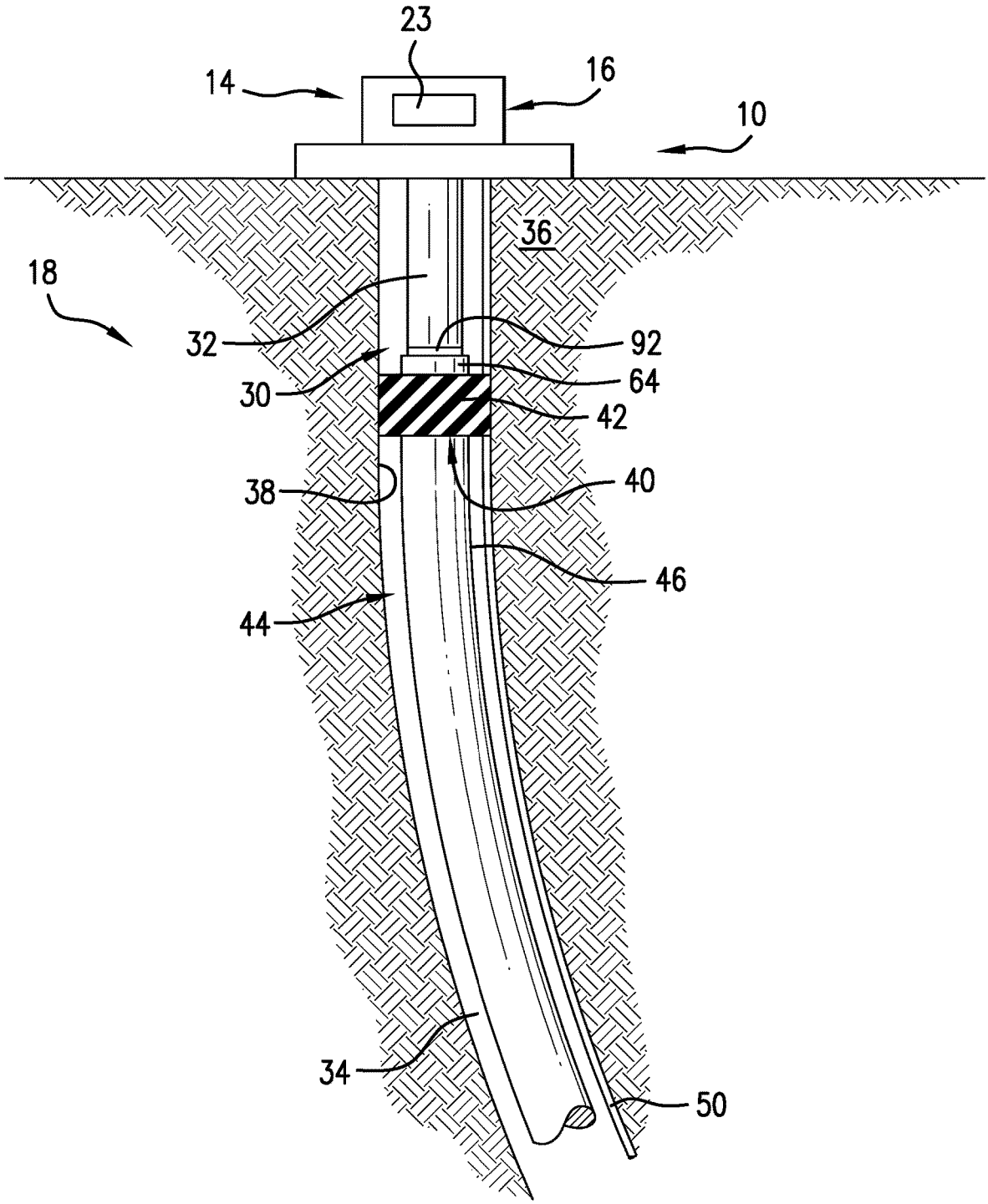
FIG. 1 depicts a resource exploration and recovery system including a control line guidance system, in accordance with an exemplary aspect.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a subterranean or subsurface system (not separately labeled). First system 14 may include a control system 23 that may provide power to, monitor, communicate with, monitor downhole parameters, and/or activate one or more downhole operations/tools as will be discussed herein. Surface system 16 may include additional systems such as pumps, fluid storage systems, cranes and the like (not shown).

Second system 18 may include a work string 30, formed from one or more tubular members, such as indicated at 32, which extends into a wellbore 34 formed in a formation 36. Work string 30 may be part of a thru tubular system (not separately labeled) that may transport production fluids to surface system 16 and/or deliver treatment fluids into wellbore 34. Wellbore 34 includes an annular wall 38 which may be defined by a surface (not separately labeled) of formation 36. At least one downhole tool 40 is provided on one of tubular members 32. Downhole tool, 40 may take the form of an expandable member, such as a packer, indicated at 42. A production zone 44 is defined downhole of packer 42. The number, length and spacing of production zones may vary. A tubular 46 extends from packer 42 downhole. Tubular 46 may include openings (not shown) that are receptive of production fluids passing from formation 36 into wellbore 34.

Figure 2:
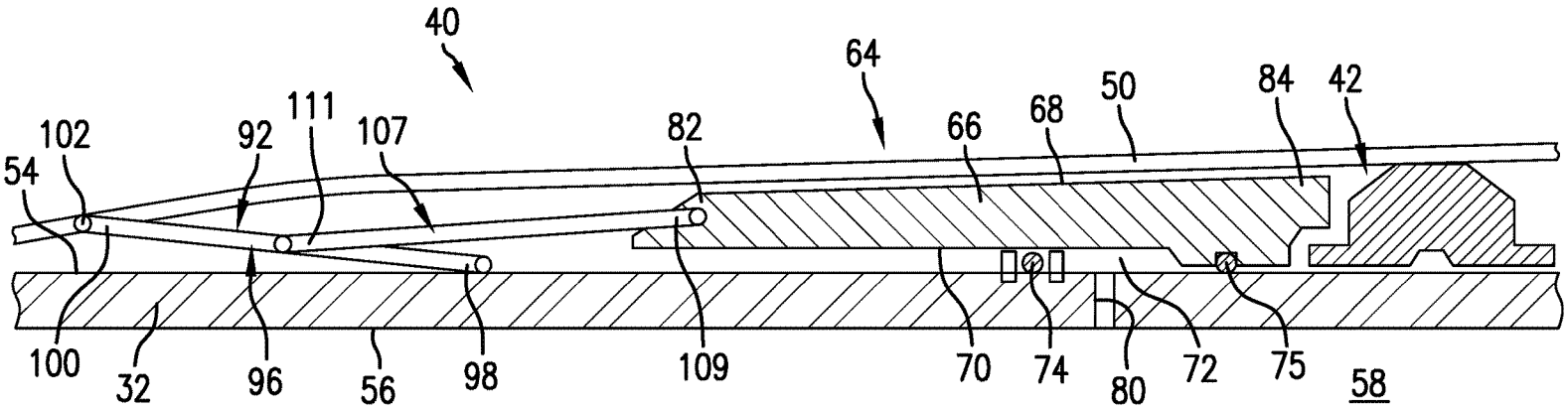
FIG. 2 depicts a control line guidance system in a non-deployed configuration, in accordance with an exemplary aspect.

In an embodiment, downhole tool 40 is provided at one of tubular members 32 having an outer surface 54 and an inner surface 56 defining a flow bore 58 as shown in FIG. 2. Downhole tool 40 includes an activation mechanism 64 operable to radially outwardly expand packer 42. Activation mechanism 64 includes a setting piston 66 provided at outer surface 54.

Setting piston 66 includes an outer surface portion 68 and an inner surface portion 70. Inner surface portion 70 is spaced from outer surface 54 by a hydraulic chamber 72 defined between a first seal 74 and a second seal 75. A setting port 80 extends from flow bore 58 to hydraulic chamber 72. While shown as being mounted radially outwardly of outer surface 54, setting piston 66 may be arranged radially inwardly of outer surface 54. Setting piston 66 also includes a first or uphole end 82 and a second or downhole end 84. At this point, it should be understood that activation mechanism 64 may include additional components.

Downhole tool 40 also includes a control line guidance system 92 that is operable to guide or shift control line 50 radially outwardly. As shown in FIG. 2, control line guidance system 92 includes a first linkage member 96 having a first end 98 pivotally mounted to outer surface 54 and a second end 100 coupled to control line 50 through a control line clamp 102. Control line clamp 102 may be configured to allow control line 50 to shift relative to first end 98. It should be understood that first end 98 may also be positioned radially inwardly of outer surface 54.

First linkage member 96 is mechanically connected to activation mechanism 118 through a second linkage member 107. More specifically, second linkage member 107 includes a first end portion 109 coupled to setting piston 66 and a second end portion 111 coupled to first linkage member 96 between first end 98 and second end 100. With this arrangement, control system 23 may direct a hydraulic fluid through flow bore 58 and into hydraulic chamber 72 via setting port 80.

Figure 3:
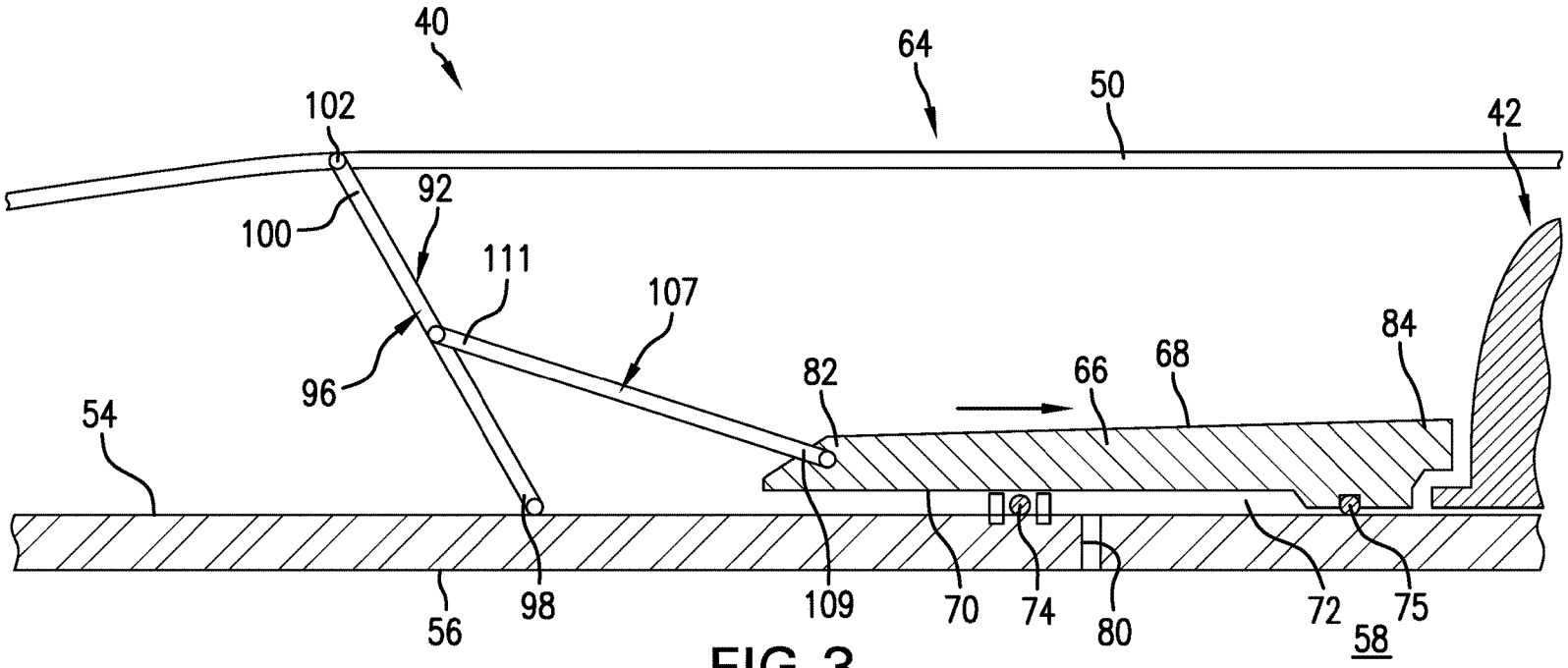
FIG. 3 depicts the control line guidance system of FIG. 2 in a deployed configuration, in accordance with an exemplary aspect.

The hydraulic fluid forces setting piston 66 toward expandable member 42. Expandable member 42 expands radially outwardly toward annular wall 38. At the same time, setting piston 80 pulls on second linkage member 107 causing first linkage member 96 to pivot and thereby shift control line 50 toward annular wall 38 as shown in FIG. 3. With this arrangement, control line guidance system 92 ensures that control line 50 does not interfere with expansion of packer 42. At this point, it should be understood that control line guidance system 92 may be designed to establish a desired timing between control line shifting and packer expansion. That is, the control line may begin shifting before the packer begins to expand; the control line may fully shift before the packer begins to expand; or the control line and the packer may move at the same time.

Figure 4:
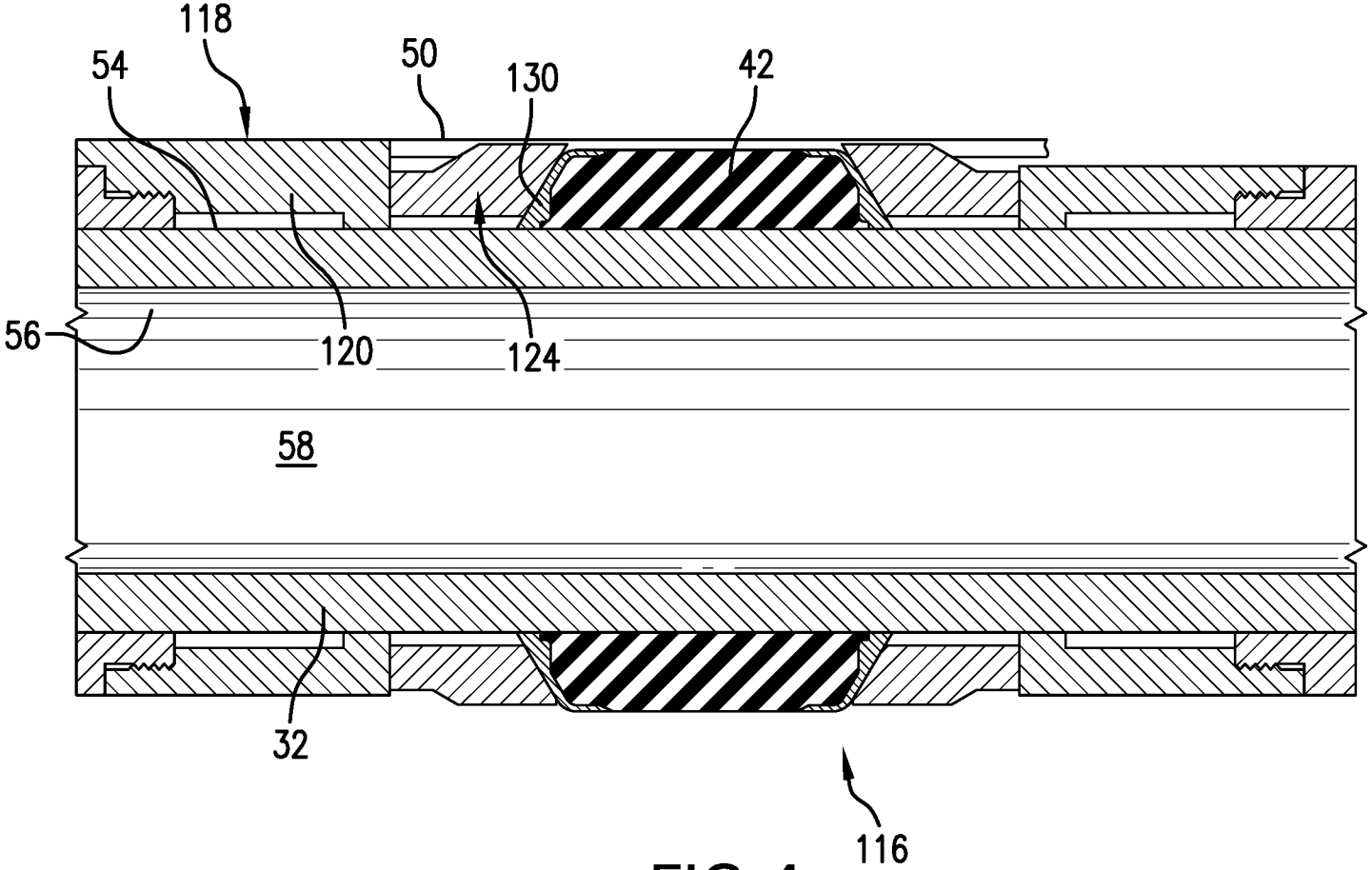
FIG. 4 depicts a tubular supporting a control line guidance system, accordance with another aspect of an exemplary embodiment.
Figure 5:
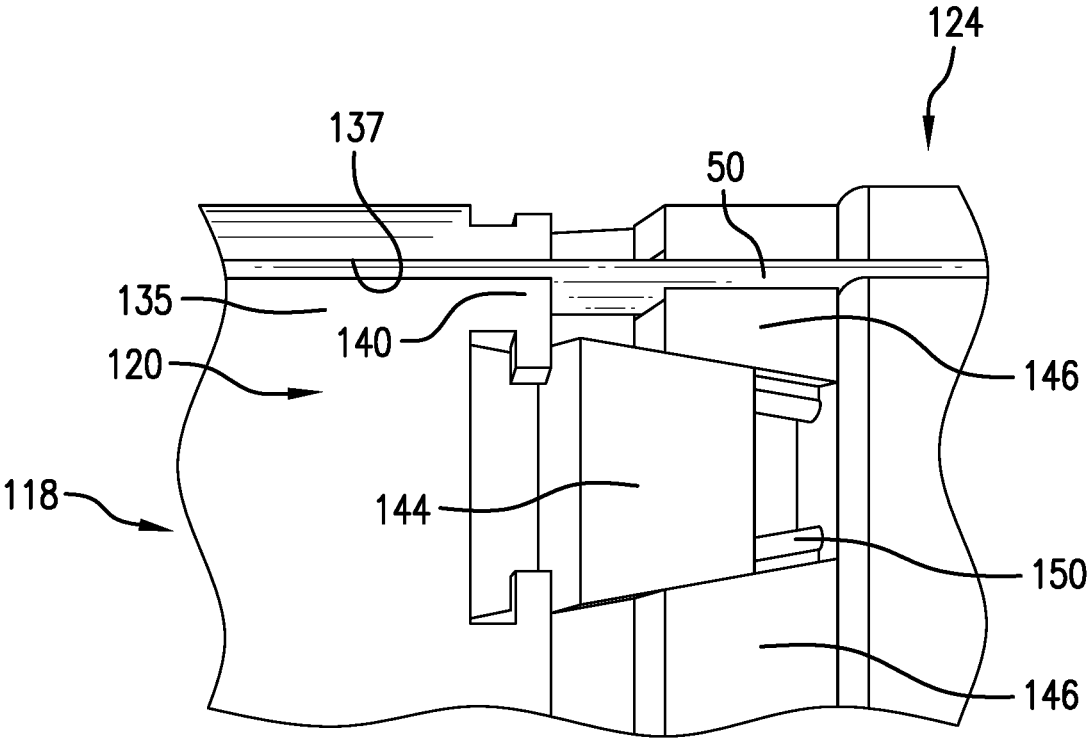
FIG. 5 depicts the control line guidance system of FIG. 4 in a non-deployed configuration, in accordance with an exemplary aspect.
Figure 6:
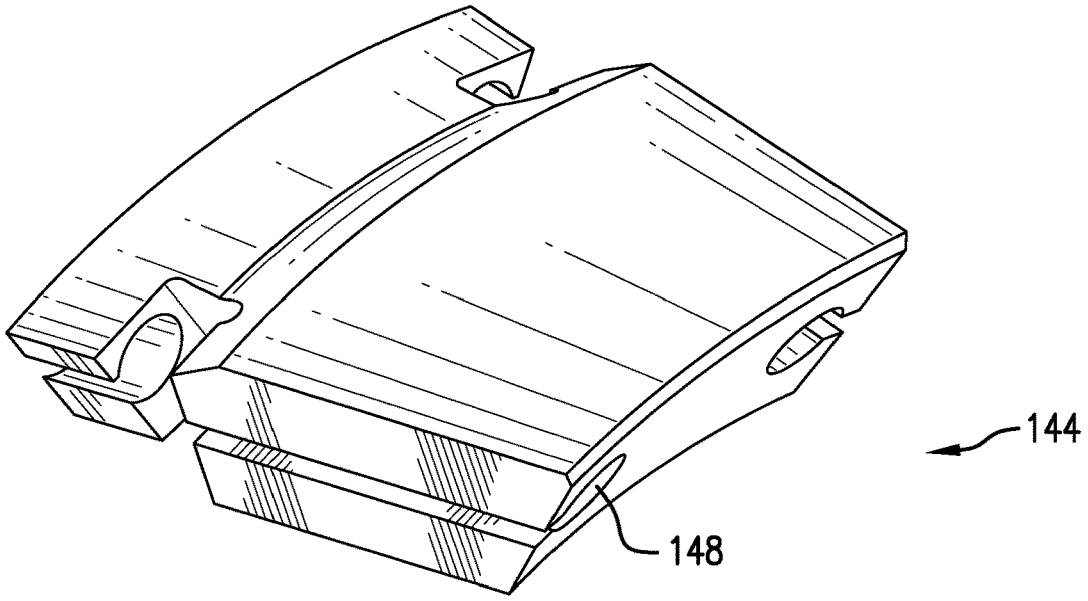
FIG. 6 depicts one of a plurality of arcuate segments of the control line guidance system of FIG. 5.
Figure 7:
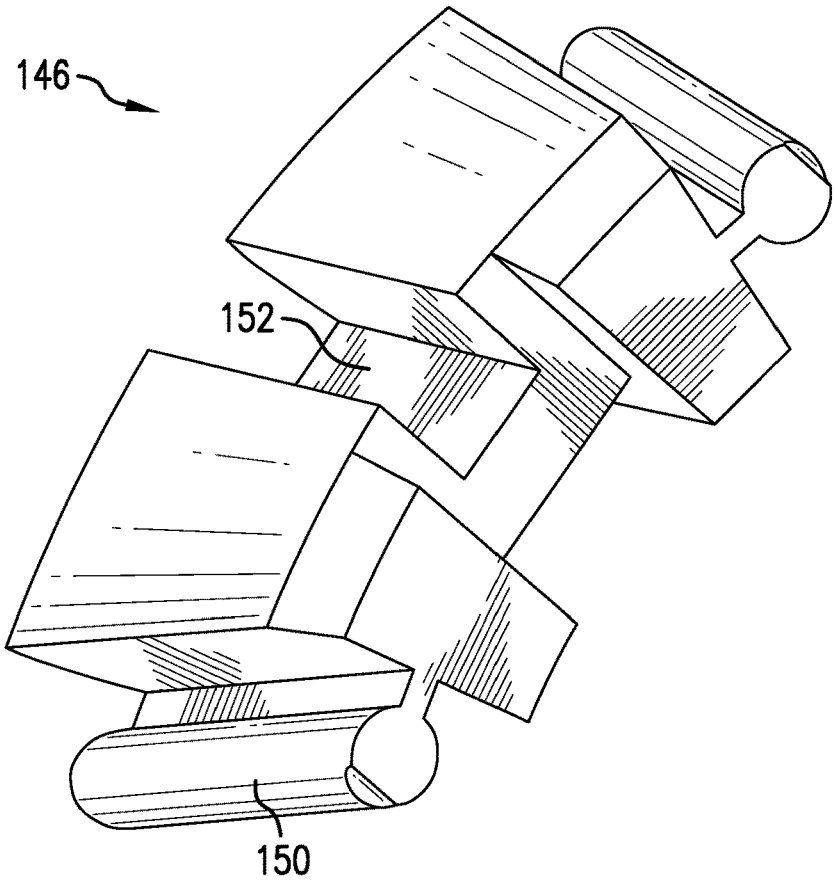
FIG. 7 depicts one of a plurality of opposing arcuate segments of e control line guidance system of FIG. 5.

Reference will now follow to FIG. 4, wherein like reference numbers represent corresponding parts in the separate views in describing a downhole tool 116 in accordance with another aspect of an exemplary embodiment. Downhole tool 116 includes an activation mechanism 118 having an annular base portion 120 that may be slideably arranged on outer surface 54 of turbular member 32. Downhole tool 116 also includes a control line guidance system 124 that is operatively associates with activation mechanism 118. A containment ring 130 is disposed between control line guidance system 124 and expandable member (packer) 42.

Referring to FIGS. 5-8, annular base portion 120 includes an outer surface section 135 including a groove 137 that is receptive of control line 50. In an embodiment, control line 50 may be slidably received in groove 137. A plurality of projections, one of which is indicated at 140 extend toward control line guidance system 124. Groove 137 extends along one of projections 140. At this point, it should be understood that the number of projections and grooves may vary. Typically, the number of grooves correspond to the number of control lines extending downhole. Further, the grooves may be distributed evenly about annular base portion 120.

Figure 8:
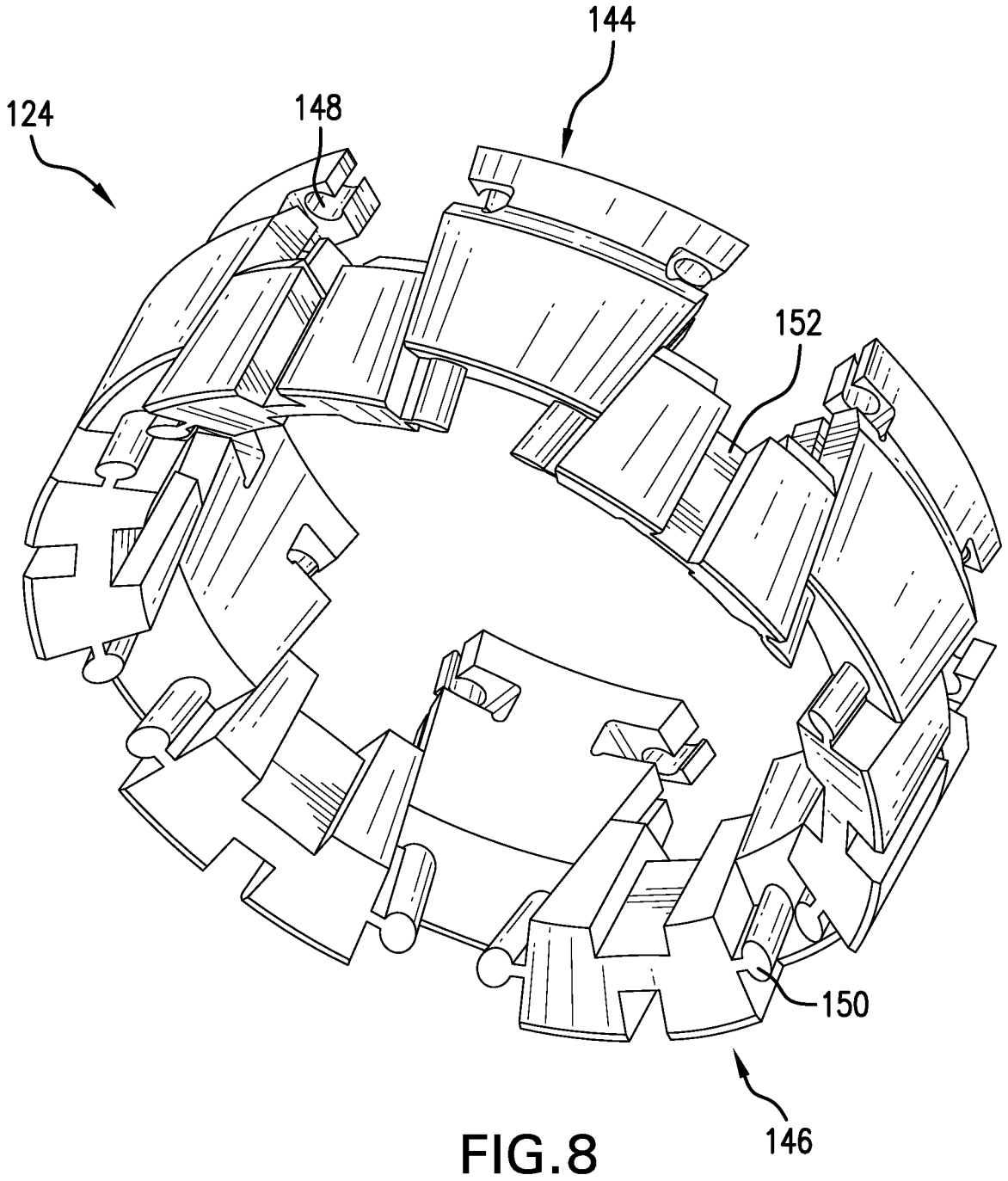
FIG. 8 depicts the plurality of arcuate segments and the plurality of opposing arcuate segments of the control line guidance system of FIG. 5.
Figure 9:
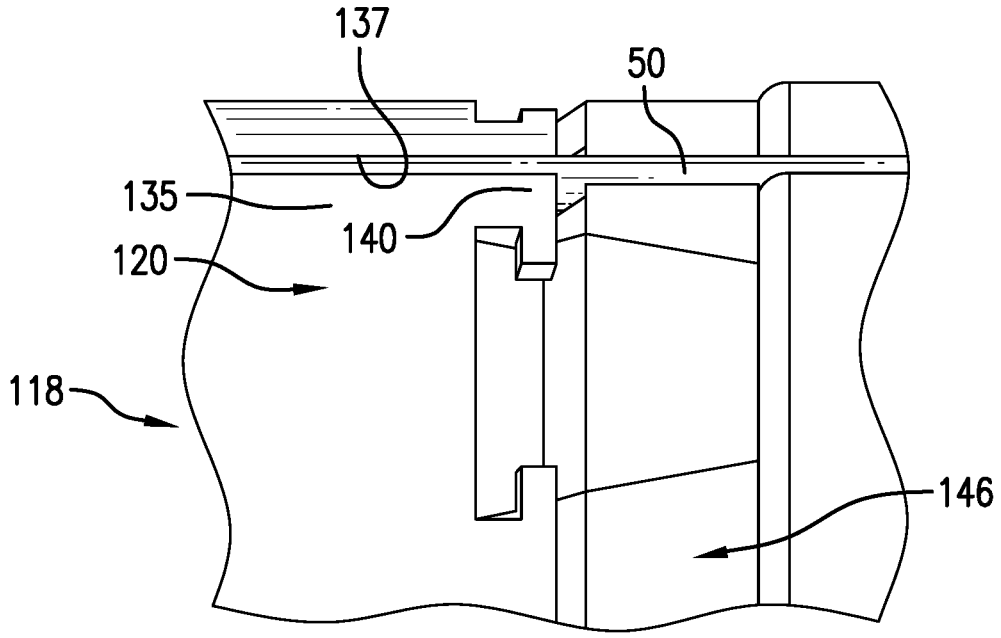
FIG. 9 depicts the control line guidance system of FIG. 4 in a deployed configuration, in accordance with an exemplary aspect.
Figure 10:
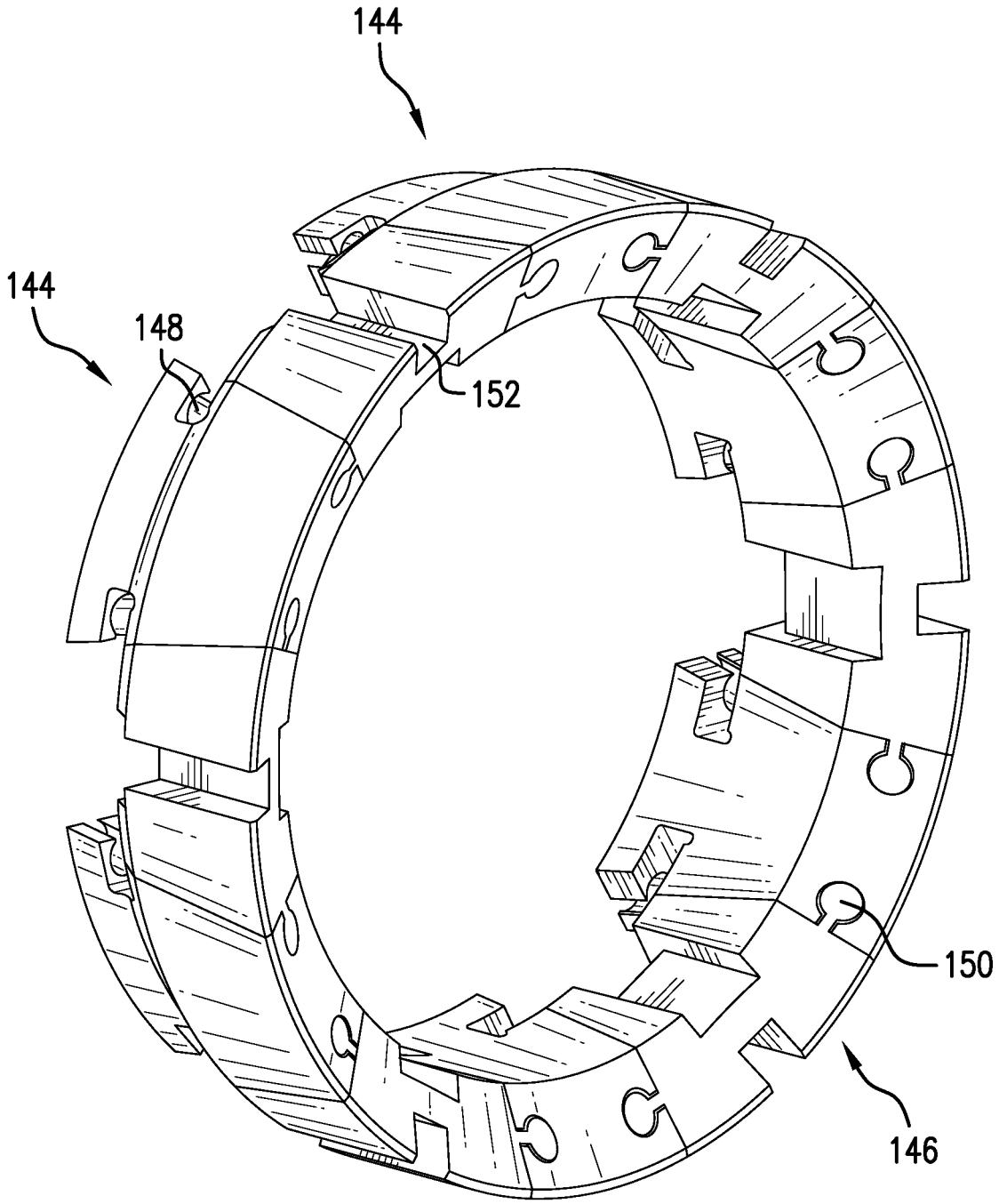
FIG. 10 depicts the plurality of arcuate segments and the plurality of opposing arcuate segments of the control line guidance system of FIG. 9.

In an embodiment, control line guidance system 124 includes a plurality of actuate segments 144 that are positioned to intermesh with a plurality of opposing arcuate segments 146 (FIG. 8). Plurality of arcuate segments 144 may include guide members such as shown at 148 in FIG. 6. Guide members 148 receive guide rails, such as shown at 150 in FIG. 7 on each of the plurality of opposing arcuate segments 146. In an embodiment, one or more of the plurality of opposing arcuate setments may include a groove 152 that is receptive of control line 50. In an embodiment, control system 23 may initiate operation of activation mechanism 118 to expand packer 42. Annular base portion 120 is shifted towards control line guidance system 124 applying a compressive force to packer 42 and plurality of arcuate segments 144 as shown in FIGS. 9 and 10.

In an embodiment, projections 140 act upon plurality of arcuate segments 144 to impart an axial movement. Angled surfaces (not separately labeled) on plurality of arcuate segments engage with and are forced between angled surface portions (also not separately labeled) on plurality of opposing arcuate segments 146. The engagement causes plurality of arcuate segments 144 and plurality of opposing arcuate segments 146 to expand radially outward. This radial outward expansion also moves control line 50 radially outwardly. As control line 50 shifts outwardly, packer 42 radially outwardly expands into contact with annular wall 38.

With this arrangement, control line guidance system 124 ensures that control line 50 does not interfere with expansion of packer 42. At this point, it should be understood that, as discussed herein, control line guidance system 124 may be designed to establish a desired timing between control line shifting and packer expansion. That is, the control line may begin shifting before the packer begins to expand; the control line may fully shift before the packer begins to expand; or the control line and the packer may move at the same time.

Set forth below are some embodiments of the foregoing disclosure:

Embodiment 1. A downhole tool comprising: a tubular member including an outer surface and an inner surface defining a flow bore; an expandable member arranged on the outer surface, the expandable member being selectively radially outwardly expandable; an activation mechanism operatively connected to the expandable member, the activation mechanism being operable to radially outwardly expand the expandable member; a control line extending along the outer surface and over the expandable member; and a control line guidance system operable to shift the control line radially outwardly from the outer surface.

Embodiment 2. The downhole tool according to any prior embodiment, wherein the control line guidance system is operatively connected to the activation mechanism.

Embodiment 3. The downhole tool according to any prior embodiment, wherein the control line guidance system includes a linkage member having a first end coupled to the control line and a second end pivotally connected relative to the outer surface.

Embodiment 4. The downhole tool according to any prior embodiment, further comprising: another linkage member extending from the linkage member to the activation mechanism.

Embodiment 5. The downhole tool according to any prior embodiment, wherein the activation mechanism includes a setting piston arranged radially outwardly of the outer surface, the another linkage member being connected between the setting piston and the linkage member.

Embodiment 6. The downhole tool according to any prior embodiment, wherein the control line guidance system includes a plurality of arcuate segments disposed annularly about the outer surface and a plurality of opposing arcuate segments disposed annularly about the outer surface in an alternating manner, wherein axial movement of the plurality of arcuate segments relative to the plurality of opposing arcuate segments shifts the control line radially outwardly.

Embodiment 7. The downhole tool according to any prior embodiment, further comprising: an annular base portion shiftably disposed on the outer surface, the annular base portion being operable to shift the plurality of arcuate segments towards the plurality of opposing arcuate segments.

Embodiment 8. The downhole tool according to any prior embodiment, wherein the control line is supported by the annular base portion.

Embodiment 9. The downhole tool according to any prior embodiment, wherein the annular base portion includes a groove, the control line being disposed in the groove.

Embodiment 10. The downhole tool according to any prior embodiment, wherein the expandable member comprises a packer.

Embodiment 11. A resource exploration and recovery system comprising: a surface system; a subsurface system including a tubular string extending from the surface system into a wellbore, the tubular string including a downhole tool comprising: a tubular member including an outer surface and an inner surface defining a flow bore; an expandable member arranged on the outer surface, the expandable member being selectively radially outwardly expandable; an activation mechanism operatively connected to the expandable member, the activation mechanism being operable to radially outwardly expand the expandable member; a control line extending along the outer surface and over the expandable member; and a control line guidance system operable to shift the control line radially outwardly from the outer surface.

Embodiment 12. The resource exploration and recovery system according to any prior embodiment, wherein the control line guidance system is operatively connected to the activation mechanism.

Embodiment 13. The resource exploration and recovery system according to any prior embodiment, wherein the control line guidance system includes a linkage member having a first end coupled to the control line and a second end pivotally connected relative to the outer surface.

Embodiment 14. The resource exploration and recovery system according to any prior embodiment, further comprising: another linkage member extending from the linkage member to the activation mechanism.

Embodiment 15. The resource exploration and recovery system according to any prior embodiment, wherein the activation mechanism includes a setting piston arranged radially outwardly of the outer surface, the another linkage member being connected between the setting piston and the linkage member.

Embodiment 16. The resource exploration and recovery system according to any prior embodiment, wherein the control line guidance system includes a plurality of arcuate segments disposed annularly about the outer surface and a plurality of opposing arcuate segments disposed annularly about the outer surface in an alternating manner, wherein axial movement of the plurality of arcuate segments relative to the plurality of opposing arcuate segments shifts the control line radially outwardly.

Embodiment 17. The resource exploration and recovery system according to any prior embodiment, further comprising: an annular base portion shiftably disposed on the outer surface, the annular base portion being operable to shift the plurality of arcuate segments towards the plurality of opposing arcuate segments.

Embodiment 18. The resource exploration and recovery system according to any prior embodiment, wherein the control line is supported by the annular base portion.

Embodiment 19. The resource exploration and recovery system according to any prior embodiment, wherein the annular base portion includes a groove, the control line being disposed in the groove.

Embodiment 20. A method of shifting a control line radially outwardly of a tubular, the method comprising: initiating an activation mechanism to radially outwardly expand an expandable member arranged on an outer surface of a tubular; actuating a control line guidance system with the activation mechanism; and radially outwardly shifting the control line relative to the outer surface with the control line guidance system.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole tool comprising:

a tubular member including an outer surface and an inner surface defining a flow bore;

an expandable member arranged on the outer surface, the expandable member being selectively radially outwardly expandable;

an activation mechanism operatively connected to the expandable member, the activation mechanism being operable to radially outwardly expand the expandable member;

a control line extending along the outer surface and over the expandable member; and a control line guidance system pivotally connected to the outer surface, the control line guidance system being operable to shift the control line radially outwardly from the outer surface.

2. The downhole tool according to claim 1, wherein the control line guidance system is operatively connected to the activation mechanism.

3. The downhole tool according to claim 2, wherein the control line guidance system includes a linkage member having a first end coupled to the control line and a second end pivotally connected relative to the outer surface.

4. The downhole tool according to claim 3, further comprising: another linkage member extending from the linkage member to the activation mechanism.

5. The downhole tool according to claim 4, wherein the activation mechanism includes a setting piston arranged radially outwardly of the outer surface, the another linkage member being connected between the setting piston and the linkage member.

6. The downhole tool according to claim 2, wherein the control line guidance system includes a plurality of arcuate segments disposed annularly about the outer surface and a plurality of opposing arcuate segments disposed annularly about the outer surface in an alternating manner, wherein axial movement of the plurality of arcuate segments relative to the plurality of opposing arcuate segments shifts the control line radially outwardly.

7. The downhole tool according to claim 6, further comprising: an annular base portion shiftably disposed on the outer surface, the annular base portion being operable to shift the plurality of arcuate segments towards the plurality of opposing arcuate segments.

8. The downhole tool according to claim 7, wherein the control line is supported by the annular base portion.

9. The downhole tool according to claim 8, wherein the annular base portion includes a groove, the control line being disposed in the groove.

10. The downhole tool according to claim 1, wherein the expandable member comprises a packer.

11. A resource exploration and recovery system comprising:

a surface system;

a subsurface system including a tubular string extending from the surface system into a wellbore, the tubular string including a downhole tool comprising:

a tubular member including an outer surface and an inner surface defining a flow bore;

an expandable member arranged on the outer surface, the expandable member being selectively radially outwardly expandable;

an activation mechanism operatively connected to the expandable member, the activation mechanism being operable to radially outwardly expand the expandable member;

a control line extending along the outer surface and over the expandable member; and a control line guidance system pivotally connected to the outer surface, the control line guidance system being operable to shift the control line radially outwardly from the outer surface.

12. The resource exploration and recovery system according to claim 11, wherein the control line guidance system is operatively connected to the activation mechanism.

13. The resource exploration and recovery system according to claim 12, wherein the control line guidance system includes a linkage member having a first end coupled to the control line and a second end pivotally connected relative to the outer surface.

14. The resource exploration and recovery system according to claim 13, further comprising: another linkage member extending from the linkage member to the activation mechanism.

15. The resource exploration and recovery system according to claim 14, wherein the activation mechanism includes a setting piston arranged radially outwardly of the outer surface, the another linkage member being connected between the setting piston and the linkage member.

16. The resource exploration and recovery system according to claim 12, wherein the control line guidance system includes a plurality of arcuate segments disposed annularly about the outer surface and a plurality of opposing arcuate segments disposed annularly about the outer surface in an alternating manner, wherein axial movement of the plurality of arcuate segments relative to the plurality of opposing arcuate segments shifts the control line radially outwardly.

17. The resource exploration and recovery system according to claim 16, further comprising: an annular base portion shiftably disposed on the outer surface, the annular base portion being operable to shift the plurality of arcuate segments towards the plurality of opposing arcuate segments.

18. The resource exploration and recovery system according to claim 17, wherein the control line is supported by the annular base portion.

19. The resource exploration and recovery system according to claim 18, wherein the annular base portion includes a groove, the control line being disposed in the groove.

20. A method of shifting a control line radially outwardly of a tubular, the method comprising:

initiating an activation mechanism to radially outwardly expand an expandable member arranged on an outer surface of a tubular;

actuating a control line guidance system pivotally connected to the outer surface with the activation mechanism; and radially outwardly shifting the control line relative to the outer surface with the control line guidance system.

* * * * *